US006607082B2

(12) United States Patent
Biagioni et al.

(10) Patent No.: US 6,607,082 B2
(45) Date of Patent: Aug. 19, 2003

(54) DEVICE FOR REMOVAL OF TRIMMINGS IN THE PRODUCTION OF ROLLS OF WEB MATERIAL

(75) Inventors: Mauro Biagioni, San Pietro a Vico Lucca (IT); Sergio Casella, Fornoli Lucca (IT)

(73) Assignee: Paper Converting Machine Co., Green Bay, WI (US)

( * ) Notice: Subject to any disclaimer, the term of this patent is extended or adjusted under 35 U.S.C. 154(b) by 57 days.

(21) Appl. No.: 09/867,807

(22) Filed: May 30, 2001

(65) Prior Publication Data

US 2002/0000400 A1 Jan. 3, 2002

(30) Foreign Application Priority Data

Jun. 20, 2000 (IT) ..... MI20A1385

(51) Int. Cl.[7] ..... B07C 5/04
(52) U.S. Cl. ..... 209/620; 198/460.2
(58) Field of Search ..... 209/620, 621, 209/622, 644, 917, 681; 198/460.2, 588, 812, 626.1; 83/89

(56) References Cited

U.S. PATENT DOCUMENTS 4,462,287 A 7/1984 Weis et al.
4,977,803 A 12/1990 Blom
5,458,033 A * 10/1995 Wierschke ..... 198/428
5,475,917 A * 12/1995 Biagiotti ..... 198/428
5,555,968 A * 9/1996 Seefeldt et al. ..... 198/594
5,873,450 A * 2/1999 Rusch et al. ..... 198/415
6,332,527 B1 * 12/2001 Wierschke ..... 198/348
6,371,304 B2 * 4/2002 Gambini ..... 198/626.1

FOREIGN PATENT DOCUMENTS

EP 0 688 132 B1 9/1998
GB 2 137 918 A 10/1994
JP 406015599 A * 1/1994

* cited by examiner

*Primary Examiner*—Donald P. Walsh
*Assistant Examiner*—Joseph Rodriguez

(57) ABSTRACT

A device for removal of trimmings obtained from cutting of logs of web material by means of a log cutting machine which include a cutting blade for log cutting and a supporting surface downstream of the cutting blade to support cut out rolls. The device for removal of trimmings is disposed downstream of the supporting surface and at least one pair of conveyor belts for conveying the rolls toward an unloading station, the lower conveyor belt having a back-up horizontally movable roller able to move toward or away from the supporting surface thus creating a gap between the supporting surface and the conveyor sufficient for the trimmings to pass through and fall beneath the machine, while the cut out rolls pass form the supporting surface to the conveyor.

10 Claims, 5 Drawing Sheets

DEVICE FOR REMOVAL OF TRIMMINGS IN THE PRODUCTION OF ROLLS OF WEB MATERIAL

BACKGROUND

The present invention refers to a device for removal of trimmings in the production of rolls of web material, in particular rolls of paper, such as toilet paper, kitchen paper, and paper for industrial and other uses. The present invention refers in particular to a device for removal of the head and tail trimmings that are obtained after cutting of rolls of a predetermined length from a long log.

Specific reference will be made herein to rolls of paper, it being understood that the invention can be applied to rolls of any other web material.

In the production of rolls of paper, a web of paper of a certain length is wound on a core, normally of cardboard, to form a log of the desired diameter. The log is then cut to form a plurality of rolls of desired length, according to the use for which the paper is intended. To obtain uniform rolls after cutting, head and tail trimming is done on each log; that is portions of variable length are cut and removed from the respective ends of each log, in which the edges of the various superimposed layers of paper are not aligned with each other.

Removal of these trimmings sometimes takes place manually, by a person set at position where the product leaves the cutting machine. Automatic systems for removal of trimmings are also known to the art, but they have not proved perfectly efficient.

A very widely used system consists in making the cut out paper rolls travel, in the stretch between the cutting station and the packaging station, on conveyor belts between which transverse slits of an appropriate width are formed, into which the head and tail trimmings should fall during the travel. In practice, however, not all the trimmings fall into the slits, causing poor operation of the machine.

SUMMARY OF THE INVENTION

An object of the invention is to eliminate the drawbacks of the prior art, ensuring removal of the head and tail trimmings in the production of rolls of paper, irrespective of the size of said trimmings.

Another object of the invention is to provide a device for removal of trimmings that is simple and cheap to make.

These objects are achieved in accordance with the invention with the characteristics listed in appended independent claim 1. Advantageous embodiments of the invention will be apparent from the dependent claims.

The device for removal of trimmings according to the invention has at least one conveyor belt disposed downstream of the cutting area of a log cutting machine. The conveyor belt is engaged on a roller that is horizontally mobile so as to be able to move towards or away from the supporting surface of the cut rolls during the cutting cycle, the trimmings are allowed to fall through the gap formed between the roller and the supporting surface and the cut out rolls are allowed to pass from the supporting surface to the conveyor belt.

Moreover said system allowing the back-up roller for the belt to be moved toward and away from the log-supporting surface also allows the passage of the pushers that push the log as it is fed toward the cutting blade.

The device for removal of trimmings according to the invention fully meets the established objects.

Removal of trimmings according to the invention fully meets the established objects.

Removal of trimmings is extremely precise, thanks to the possibility of horizontal movement of the conveyor belt roller which may be linked to the feeding movement of the logs.

Moreover, the device according to the invention works in the greatest safety, precisely because the back-up roller of the conveyor belt moves away from the roll-supporting surface at the moment when the pusher has to pass, thus avoiding any impact of the pusher with parts of the machine.

DESCRIPTION OF THE DRAWINGS

Further characteristics of the invention will be made clearer by the detailed description that follow, referring to purely exemplary and therefore non-limiting embodiment thereof, illustrated in the appended drawings, in which.

DESCRIPTION OF SPECIFIC EMBODIMENT

An embodiment of the device for removal of trimmings in the production of rolls of web material according to the invention is described with the aid of the figures.

Figure 1:
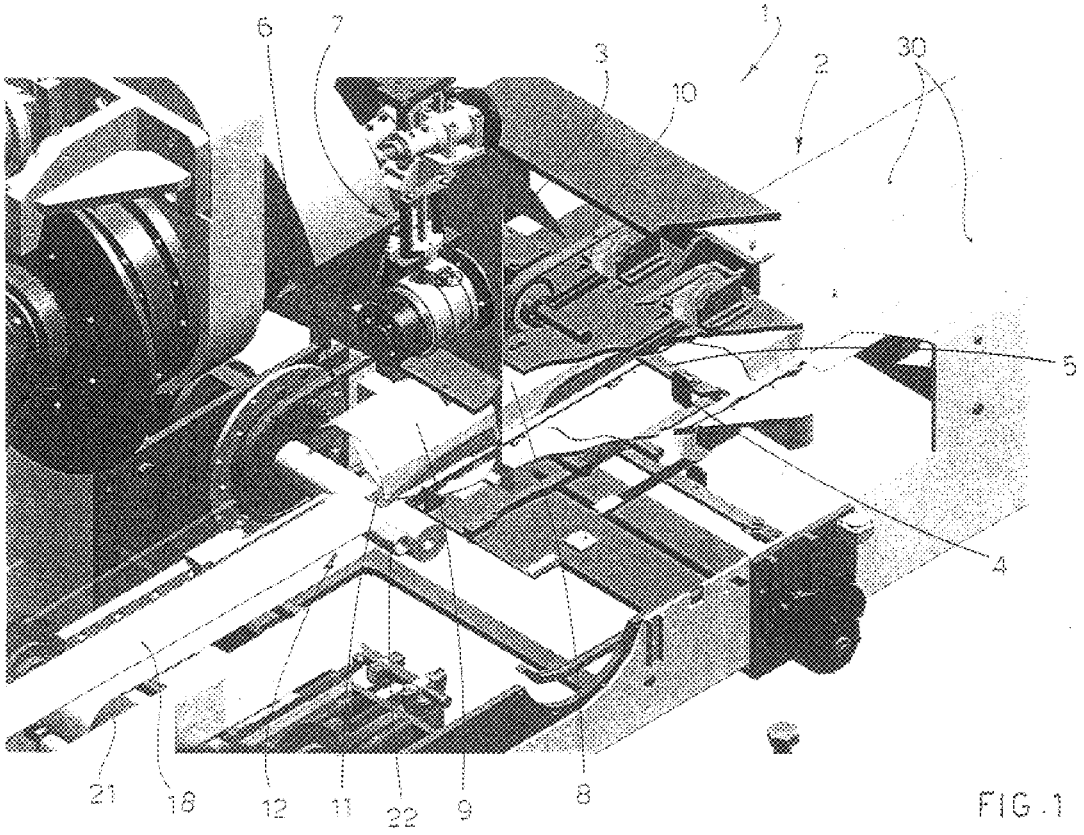
FIG. 1 is a perspective view, partially illustrating a log cutting machine to which the device according to the invention is applied, in which for clarity's sake some parts have been removed.

FIG. 1 partially illustrates a cutting machine, designated as a whole with reference numeral 1.

The cutting machine 1 comprises a conveyor 2 for feeding the logs toward a cutting blade 3. The conveyor 2 has one or more parallel channels 30 disposed on a horizontal plane, wherein the logs are conveyed pushed from behind by pusher arms or pushers 4 mounted on a bar 5 the ends of which are constrained to endless belts or chains 6 disposed laterally with respect to the feeding surface for the logs.

The cutting blade 3 is supported by a drive assembly 7 which gives it a rotary movement about its own axis and an elliptical movement to move toward and away from the surface of the log to be cut.

Two pairs of longitudinal guides 8 and 9 are provided through which the log passes, respectively disposed upstream and downstream of the blade 3. A narrow gap is left between the two guides 8 and 9 through which the blade 3 can pass to perform cutting of the log. Pressure means, such as a pair of endless belts 10 disposed above and below the feeding surface for the log, are provided in the guide 8 upstream of the blade 3 to hold the log still during cutting.

Beneath the guide 9 and downstream of the blade 3 there is a supporting surface 11, which can slide telescopically to have its length adjusted according to the length of the rolls to be cut.

Downstream of the supporting surface 11 is a device for removal of trimmings according to the invention, designated as a whole with reference numeral 12 (in FIG. 1 it is shown partially). The trim removal device 12 takes the rolls of paper cut by the blade 3 and supported by the surface 11 and lets the trimmings fall into the space below the machine.

As shown better in the other figures, the trim removal device 12 comprises a pair of endless conveyor belts 13 and 14, disposed respectively above and below an ideal feeding plane for the logs. The upper conveyor belt 13 has an endless belt or chain 15 on two rollers 16 and 17 at least one of which is motorized and driven from a motor system. The axes of the rollers 16 and 17 lie on a horizontal plane above the feeding plane for the logs. A drive system (not shown) is provided to vertically shift the rollers 16 and 17, so that the conveyor belt 13 can adapt to the diameter of the rolls being cut.

The conveyor belt 14 has an endless belt or chain 18 on a pair of pulleys 19 and 21 and on a pair of rollers 20 and 22. The axes of the pulleys 19 and 21 lie on a horizontal plane below the feeding surface for the logs. The pulley 21 has a smaller diameter than the pulley 19. The diameter of the roller 20 is substantially equal to that of the roller 22 and smaller than the diameter of the pulley 21. The sum of the diameters of the pulley 21 and the rollers 20 and 22 is equal to the diameter of the pulley 19.

The axis of the roller 22 is disposed at such a height that the portion of belt 18 between the pulley 19 and the roller 22 is disposed on a horizontal plane substantially at the same height as the supporting surface 11 for the cut rolls. The axis of the roller 20, on the other hand, is at such a height that the portion of belt 18 comprised between the pulley 19 and the roller 20 is on a substantially horizontal plane.

The geometry of the conveyor belt 14 can, however, be different from that described. In fact, with the aid of a back-up roller the pulley 19 can have a smaller diameter than the pulley 21.

The rollers 22 and 20 can translate horizontally so as to move toward and away from the supporting surface 11 for the cut out rolls. In particular, the distance between the roller 22 and the end of the supporting surface 11 is adjusted to be smaller than the length of the cut out rolls, so that the cut out rolls can pass from the supporting surface 11 to the conveyor belt 14 and be conveyed toward the outlet, whereas the trimmings, having a substantially shorter length than that of the rolls, can fall below the machine through the gap left between the roller 22 and the supporting surface 11.

In the event of the cut out rolls having too short a length, the space left between the roller 22 and the supporting surface 11 proves too narrow to allow the passage of the pusher 4 that has pushed the log which has been cut into rolls. Consequently, at the moment when the pusher 4 passes, the roller 22 is made to retract so as to leave sufficient space for the pusher 4 to pass. Once the pusher has passed, the roller 22 is made to advance to position itself once more at a shorter distance from the supporting surface 11 than the length of a roll.

To achieve this, the horizontal movement of the roller 22 must be synchronized with the movement of the belt or chain 6 that carries the pushers 4, so that the roller 22 retracts each time the pusher goes beyond the supporting surface 11. Moreover, the horizontal movement of the roller 20 is clearly synchronized with the horizontal movement of the roller 22. In fact, to maintain the tension of the belt 18 constant, when the roller 22 moves forward, the roller 20 moves backward and, vice versa, when the roller 22 moves backward, the roller 20 moves forward.

To speed up the fall of the cut trimmings, an air blowing device 60 can be provided, mounted above the gap between the supporting surface 11 and the conveyor belt 14. The air blowing device 60 comes into operation when the trimming reaches the end of the supporting surface 11.

Operation of the device 12 for removal of trimmings according to the invention is shown below with reference to FIGS. 2*a*–2*f*, in the case of rolls of a small length.

Figure 2A:
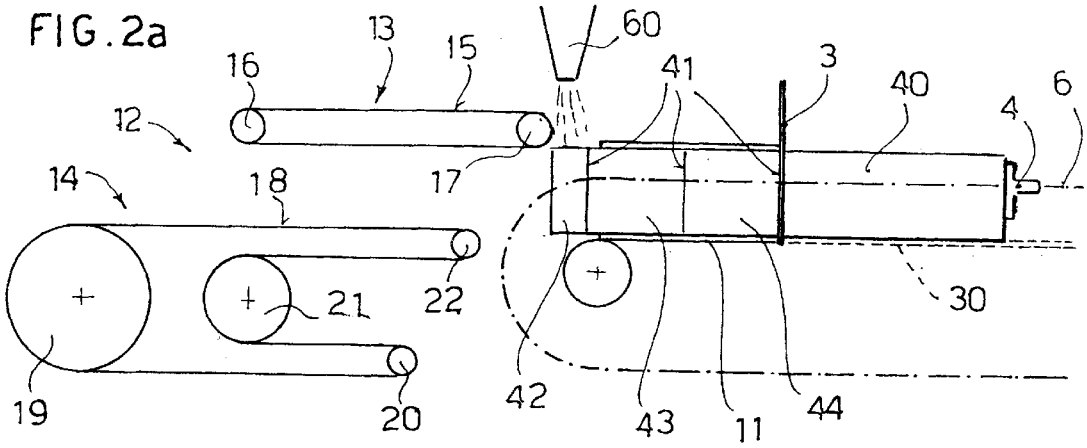
FIGS. 2*a*–2*f* are diagrammatic views illustrating a complete cycle for cutting logs into rolls of limited length.

FIG. 2*a* shows a log 40 that advances in a channel 30 of the conveyor 2 and the cutting blade 3 that has made three cuts 41 so as to generate a head trimming 42 and two rolls 43 and 44. The two rolls 43 and 44 are still supported by the supporting surface 11 and the head trimming 42 has just gone beyond the supporting surface 11. In this initial situation the roller 22 is at such a distance from the supporting surface 11 as to allow the head trimming 42 to pass in the gap left between the roller 22 and the supporting surface 11. As shown in FIG. 2*a*, in this situation the air-blowing device 60 begins to act by blowing air onto the trimming 42.

Figure 2B:
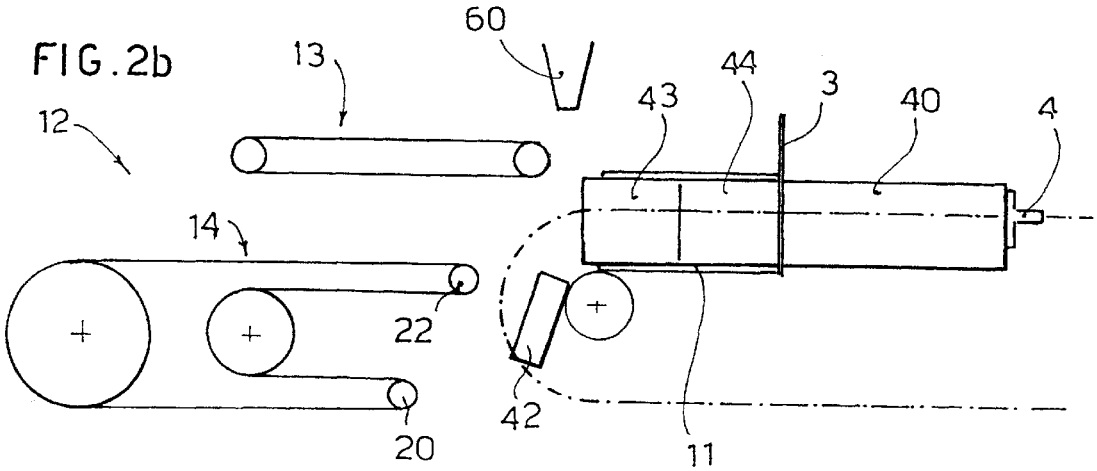

In FIG. 2*b* it can be seen that the head trimming 42, aided by the action of the air-blowing device 60, passes in the gap between the roller 22 and the supporting surface 11 and falls beneath the machine where it will later be collected.

Figure 2C:
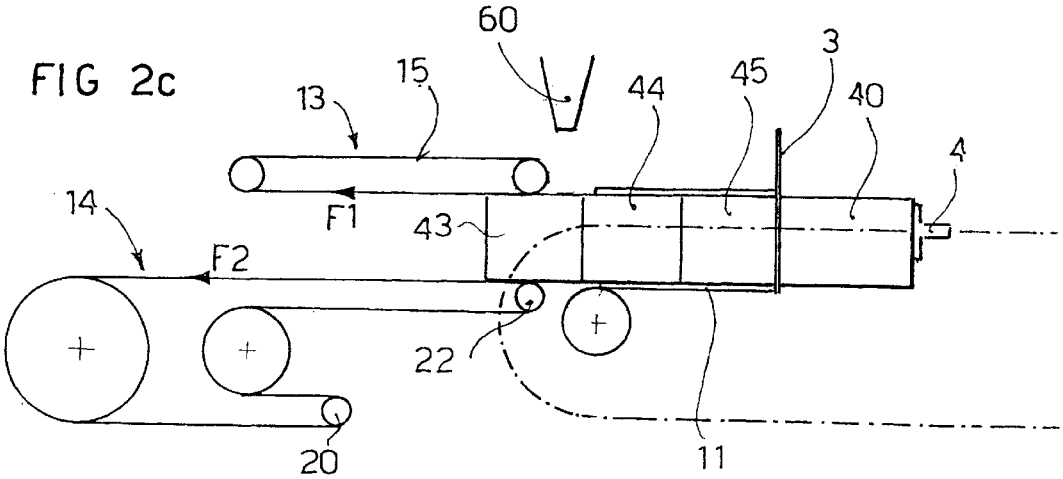

As shown in FIG. 2*c*, after removal of the head trimming, the roller 22 moves forward toward the supporting surface 11 and at the same time the roller 20 moves back to maintain the pull of the belt 18 constant. The roller 22 moves to a distance from the supporting surface 11 shorter than the length of the rolls that have been cut out.

The log 40 is made to advance by another step and the blade 3 performs another cut giving rise to a third roll 45. Meanwhile the first roll 43 is pressed between the upper conveyor belt 13 and the lower conveyor belt 14. In fact the length of the roll 43 is greater than the distance between the roller 22 and the surface 11. Thus the roll 43 can pass from the surface 11 to the conveyor 14 without falling into the gap formed therebetween. The belts 15 and 18 of the conveyors 13 and 14 rotate in the direction of the arrows F1 and F2 respectively. Thus the roll 43 picked up by the conveyors 13 and 14 advances in the direction of said arrows.

Figure 2D:
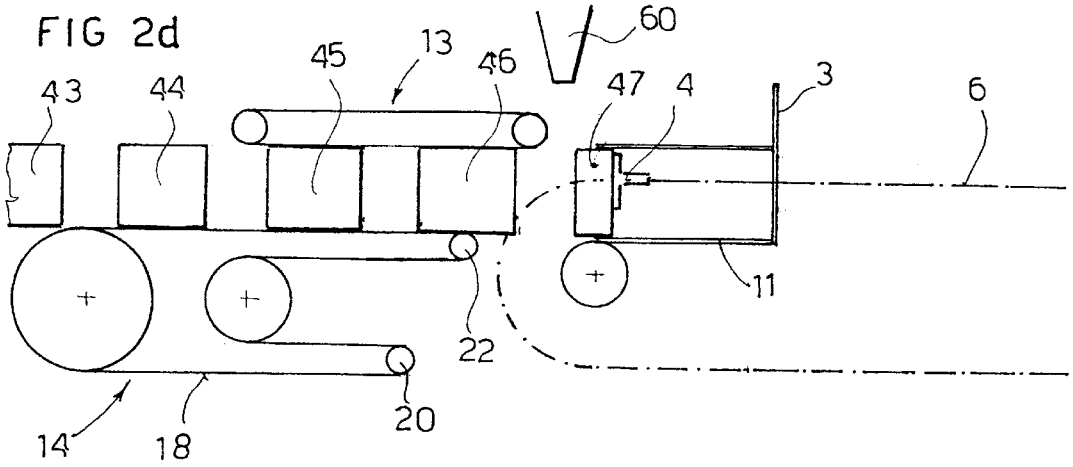

In FIG. 2*d* it can be seen that the blade 3 has made another cut, giving rise to a fourth roll 46 and a tail trimming 47. After the last roll 46 has been taken by the pair of conveyor belts 13 and 14, the roller 22 moves back to leave a space, between it at the supporting surface 11, sufficient to allow the tail trimming 47 to fall through and at the same time the roller 20 advances to keep the pull on the belt constant. In this case the distance between the roller 22 and the supporting surface 11 must be sufficient to allow the pusher 4 that pushes the tail trimming 47 to pass.

Figure 2E:
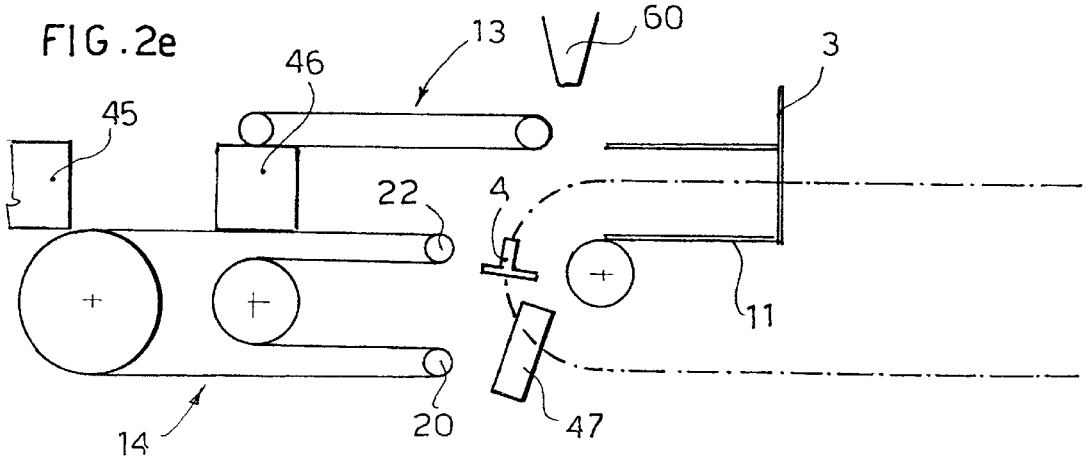

In FIG. 2*e* it can be seen that the pusher 4 passes in the gap between the roller 22 and the supporting surface 11.

Figure 2F:
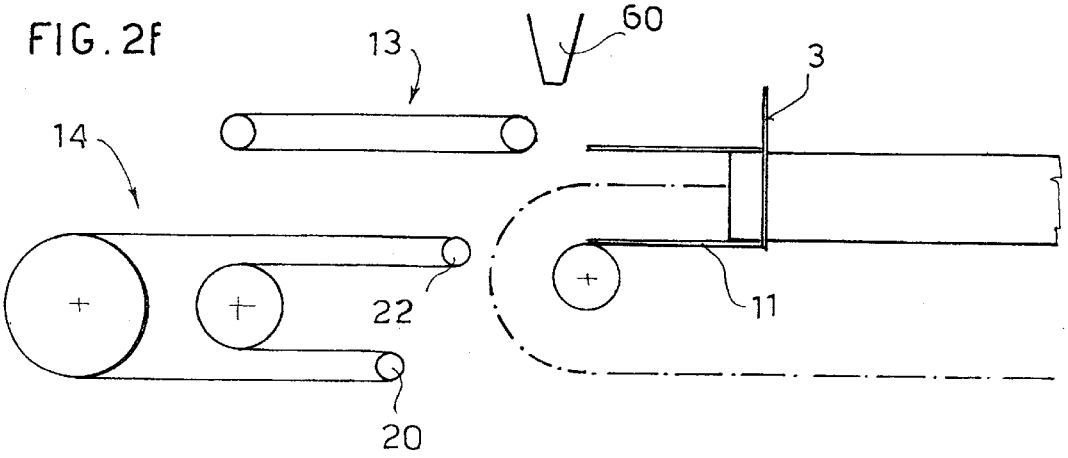

After the pusher 4 has passed in the gap between the roller 22 and the supporting surface 11, as shown in FIG. 2*f*, the roller 22 moves forward and at the same time the roller 20 moves back, so as to reposition itself in the starting position shown in FIG. 2*a* and thus a new cutting cycle begins on another log.

Operation of the trim removal device 12 according to the invention is shown below, with reference of FIGS. 3*a*–3*f*, in the case of cutting of rolls of a great length. In this situation the space between the roller 22 and the supporting surface 11 is adjusted to be sufficiently wide to allow easy passage of trimmings. Consequently, in this situation, the device for blowing air is not strictly necessary and therefore is not illustrated in FIGS. 3*a*–3*f*.

Figure 3A:
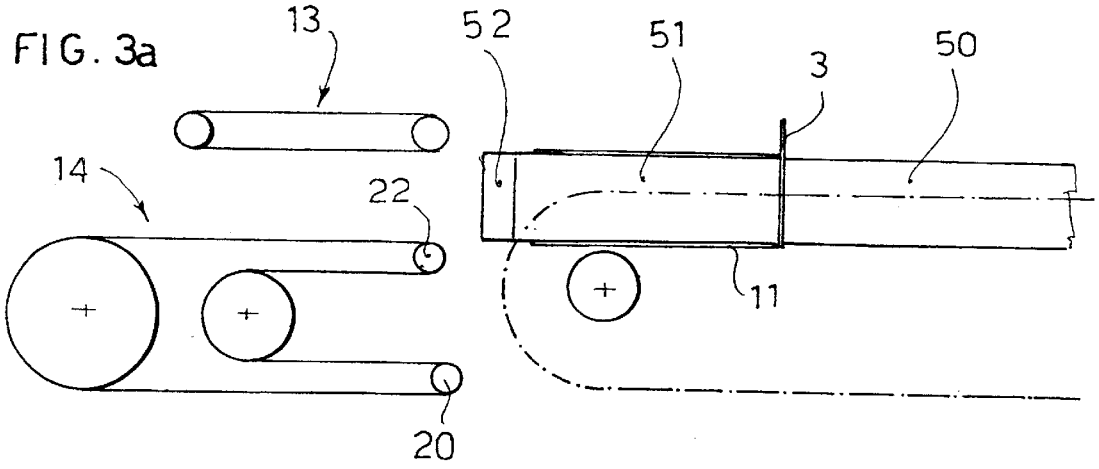
FIGS. 3*a*–3*f* are diagrammatic views illustrating a complete cycle for cutting logs into rolls of considerable length.
Figure 3B:
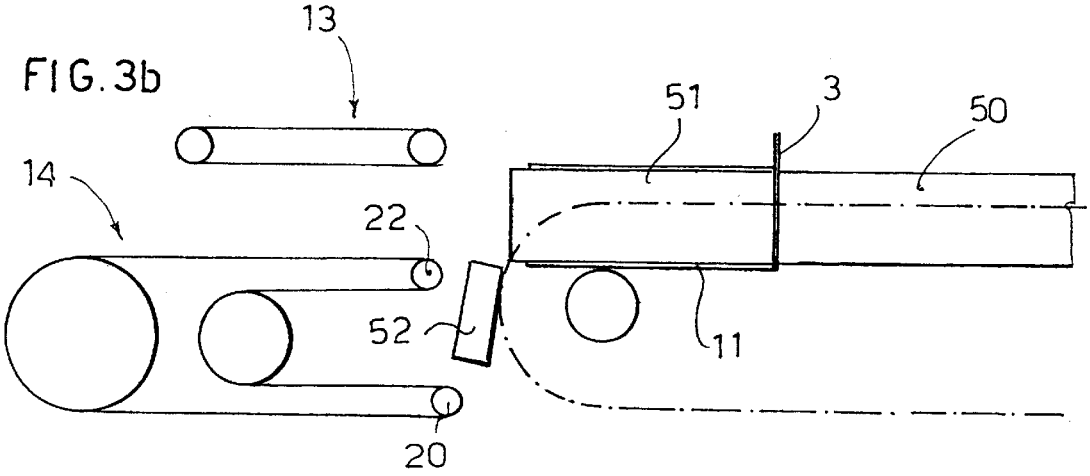
Figure 3C:
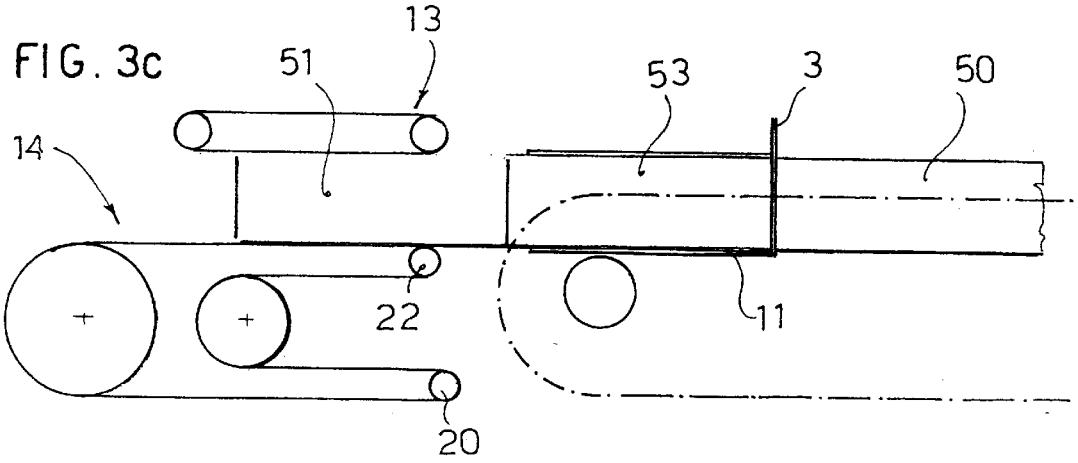

In FIG. 3*a* a log 50 is shown that has undergone two cuts, giving rise to a roll of considerable length 51 and a head trimming 52. The roller 22 is positioned at a distance from the supporting surface 11 such as to allow the head trimming 52 to fall.

Figure 3D:
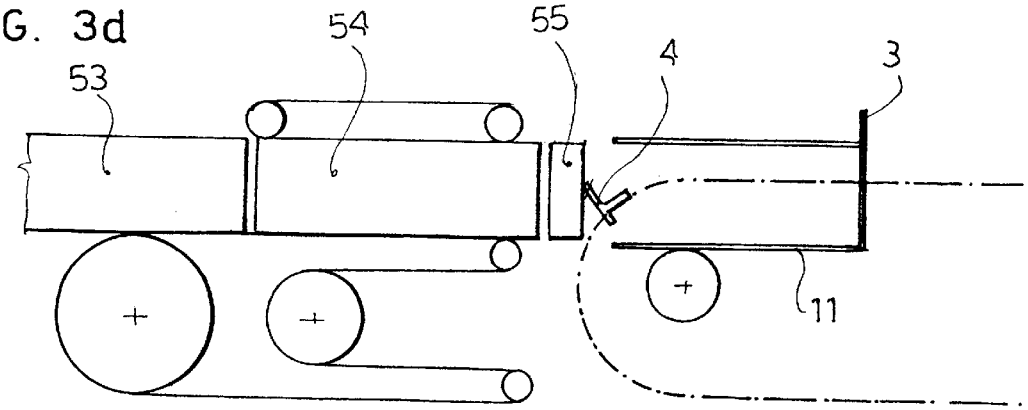

FIG. 3*d* shows the moment when the last roll 54 and the tail trimming 55 have been generated. In this condition, the distance between the roller 22 and the supporting surface 11 remains unchanged, allowing the last roll 54 to pass from the supporting surface 11 to the conveyor 14 and allowing the tail trimming 55 to fall in the gap between the roller 22 and the supporting surface 11.

FIG. 3*d* the moment when the last roll 54 and the tail trimming 55 have been generated. In this condition, the distance between the roller 22 and the supporting surface 11 remains unchanged, allowing the last roll 54 to pass from the supporting surface 11 to the conveyor 14 and allowing the tail trimming 55 to fall in the gap between the roller 22 and the supporting surface 11.

Figure 3E:
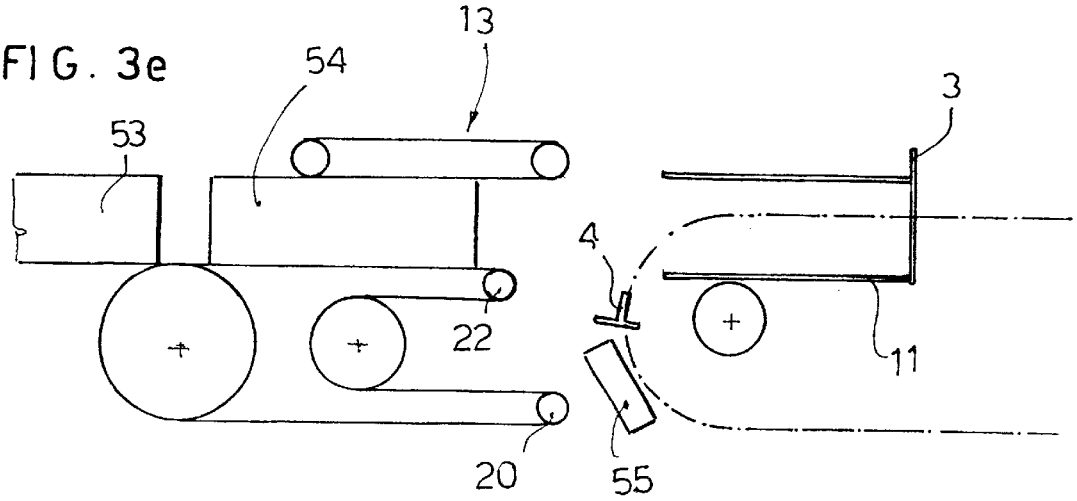

As shown in FIG. 3*e,* when the pusher 4 goes beyond the supporting surface 11, the roller 22 is moved back and at the same time the roller 20 is moved forward. In this manner the gap between the roller 22 and the supporting surface 11 is increased to allow the pusher 4 to pass without the risk of it striking parts of the machine. However, situations can occur in which the gap between the roller 22 and the supporting surface 11 is sufficient to allow the pusher 4 to pass without the need to move back the roller 22.

Figure 3F:
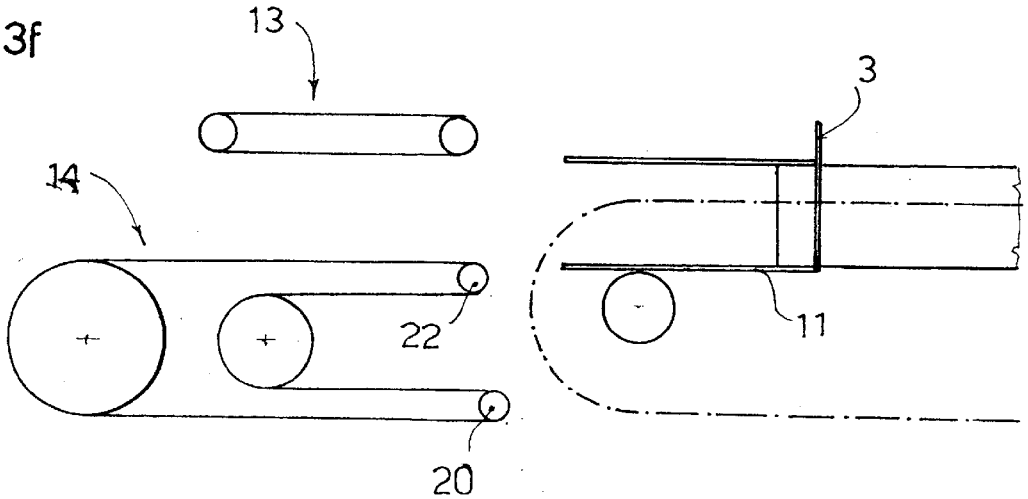

As shown in FIG. 3*f,* after the pusher has passed through the gap between the roller 22 and the supporting surface 11, the roller 22 is moved forward and the roller 20 is moved back, so as to restore the initial condition shown in FIG. 3*a,* for the start of a new cutting cycle on another log.

Numerous changes and modifications of detail within the reach of a person skilled in the art can be made to the present embodiment, without departing from the scope of the invention set forth in the appended claims.

We claim:

1. A device for removal of trimmings obtained from cutting a log of web material by means of a log cutting machine having at least one cutting blade for log cutting and at least one supporting surface disposed downstream of the cutting blade for supporting cut rolls, comprising:

a conveyor for conveying rolls away from the supporting surface, said conveyor including:

a fixed rotatable pulley, an upper movable roller above the pulley, a lower movable roller below the pulley, a conveyor belt extending around the lower movable roller, the pulley, and the upper movable roller, the upper movable roller being movable toward and away from said supporting surface to provide a variable gap between the conveyor and said supporting surface, the upper movable roller being movable away from said pulley as the upper movable roller moves toward said supporting surface and being movable toward said pulley as the upper movable roller moves away from said supporting surface, the lower movable roller being movable toward said pulley as the upper movable roller moves toward said supporting surface and being movable away from said pulley as the upper movable roller moves away from said supporting surface, whereby the length of the belt between the upper and lower movable rollers remains constant as the upper and lower movable rollers move.

2. The device of claim 1 including a pusher mounted on a second conveyor for moving a log toward the cutting blade, the pusher moving into said gap after the pusher passes the cutting blade, said upper roller being movable away from said supporting surface to permit the pusher to move into the gap.

3. The device of claim 1 including an upper conveyor positioned above said first-mentioned conveyor, the spacing between the upper conveyor and the first conveyor corresponding to the height of the rolls whereby rolls can be moved by the upper conveyor and the first conveyor.

4. The device of claim 3 in which the speed of the upper conveyor is synchronized with the speed of the first conveyor.

5. The device of claim 3 in which the upper conveyor is movable vertically whereby rolls of varying height can be accommodated between the conveyors.

6. The device of claim 4 in which the upper conveyor is movable horizontally.

7. A. The device of claim 1 including a second fixed rotatable pulley, said conveyor belt extending from said upper movable roller to said second fixed rotatable pulley.

8. The device of claim 7 in which the portion of said conveyor belt between the upper movable roller and the second fixed rotatable pulley is vertically aligned with said supporting surface.

9. The device of claim 7 in which said second pulley in said first-mentioned pulleys have axes which are horizontally aligned, the second pulley having a larger diameter than the first pulley.

10. The device of claim 1 including an air blower above said gap for facilitating removal of trimmings.

* * * * *